US008517864B2

(12) United States Patent
Spiegel

(10) Patent No.: US 8,517,864 B2
(45) Date of Patent: Aug. 27, 2013

(54) MULTI-PURPOSE FOOTBALL TEES

(75) Inventor: H. Jay Spiegel, Mount Vernon, VA (US)

(73) Assignee: Premium Products, Inc. VA (US)

( * ) Notice: Subject to any disclaimer, the term of this patent is extended or adjusted under 35 U.S.C. 154(b) by 207 days.

(21) Appl. No.: 13/067,740

(22) Filed: Jun. 23, 2011

(65) Prior Publication Data

US 2012/0329582 A1 Dec. 27, 2012

(51) Int. Cl.
*A63B 69/00* (2006.01)
*A63B 71/00* (2006.01)

(52) U.S. Cl.
USPC ..... 473/420; 473/438

(58) Field of Classification Search
USPC ..... 473/420, 419, 417, 438, 387, 396; D21/716, 717, 788, 793; 248/121, 156
See application file for complete search history.

(56) References Cited

U.S. PATENT DOCUMENTS

| | | | | |
|---|---|---|---|---|
| D277,973 | S * | 3/1985 | Stenerud | D21/716 |
| 4,655,453 | A | 4/1987 | Spiegel | |
| 4,657,252 | A | 4/1987 | Spiegel | |
| D291,714 | S | 9/1987 | Spiegel | |
| D305,448 | S | 1/1990 | Spiegel | |
| D372,062 | S | 7/1996 | Spiegel | |
| D383,816 | S | 9/1997 | Spiegel | |
| D383,817 | S | 9/1997 | Spiegel | |
| D392,705 | S | 3/1998 | Spiegel | |
| 6,309,316 | B1 | 10/2001 | Spiegel | |
| D489,779 | S | 5/2004 | Spiegel | |
| D507,315 | S | 7/2005 | Spiegel | |
| D507,814 | S | 7/2005 | Spiegel | |
| D513,775 | S | 1/2006 | Spiegel | |
| D664,221 | S * | 7/2012 | Spiegel | D21/716 |
| 8,262,514 | B2 * | 9/2012 | Spiegel et al. | 473/420 |
| 2005/0181893 | A1 * | 8/2005 | Slaven | 473/387 |
| 2012/0322586 | A1 * | 12/2012 | Mourouzis et al. | 473/419 |

* cited by examiner

*Primary Examiner* — Mitra Aryanpour
(74) *Attorney, Agent, or Firm* — H. Jay Spiegel

(57) ABSTRACT

A football tee combines three ball receiving recesses into a single tee. The ball receiving recesses include a first ball receiving recess for conventional kicks, a second ball receiving recess for squib kicks, and a third ball receiving recess for onside kicks. In a first embodiment, the first ball receiving recess consists of a plurality of elongated arcuate lines with each line conforming to the shape of the surface of the football near the tip. In a second embodiment, the lines are replaced by a similar number of arcuate narrow bands, each of which conforms to the shape of the football above the tip. In a third embodiment, a series of semi-spherical projections are provided, each of which engages the football in a point contact. The bottom of the first recess is open to reduce surface area of ball contact.

27 Claims, 7 Drawing Sheets

MULTI-PURPOSE FOOTBALL TEES

BACKGROUND OF THE INVENTION

The present invention relates to multi-purpose football tees. Many years ago, up until the early 1980s, when an American football was to be place kicked off a tee, the tee consisted of a surface supporting the tip of the football and at least two upstanding prongs against which the surface of the football leaned to provide a support for kicking a football. Applicant developed the first tee that utilized the concept of a recessed surface shaped to mimic the shape of the surface of the football to provide a surface contact with the ball with the tee devoid of any upstanding prongs.

Back in the days when place kickers kicked the ball with their toe in what was described as "conventional" kicking, the kicker's kicking foot could hit the ball while the bottom of the foot or the shoe he was wearing and its cleats easily cleared the top portions of the prongs. When place kickers began using what is now described as "soccer-style" kicking technique, led by the Gogolak brothers, Peter at Cornell University and Charlie at Princeton University, in the early to mid 1960s, the upstanding prongs became a problem. Soccer-style kickers kicked the ball with their toe down and the toe or end of the shoe would often hit one or both of the prongs immediately prior to the foot or shoe striking the ball, thus slightly dislodging the ball just prior to impact. The result was slight movement of the ball and inability to gain a clean hit on the ball. The football would typically travel down the field, not in a uniform end over end spin but in a fluttering spin that reduced height, distance, and accuracy.

Applicant's development and commercialization of tees using a recess to support the football solved this problem. As a result, kickers could gain a clean hit on the ball which did not move until struck directly by the foot or shoe. This resulted in increased accuracy, height, and distance.

Initial versions of Applicant's tees were covered by U.S. Pat. Nos. 4,655,453 issued Apr. 7, 1987, 4,657,252 issued Apr. 14, 1987, D 291,714 issued Sep. 1, 1987, D 305,448 issued Jan. 9, 1990.

In 1988, the National Football League (NFL) approved for game use Applicant's tee consisting of the combination of the base of U.S. Pat. No. D 305,448, and the kicking tee insert of U.S. Pat. No. D 291,714.

Several NFL kickers began using that tee which was known by the registered Trademark TOE-TAL®. However, the base was made of a hard plastic and all too often kickers would strike the base and crack it. This necessitated maintaining an inventory of replacement bases with which to supply kickers.

Thus, a need arose for a kicking tee with a base that was more resilient so that it could be struck by a kicker's foot or shoe without resultant breakage. Thus, evolved the second generation TOE-TAL® tee covered by U.S. Pat. Nos. D 372,062, D 383,816, D 383,817, and D 392,705. The second generation TOE-TAL® tee became quite popular in high schools and colleges and in the professional ranks including the NFL. It was used in NFL games starting around 1996 in the configuration shown in FIGS. 1 and 2 of U.S. Pat. No. D 383,816. However, problems arose when NFL officials began noticing kickers pushing the rubber insert up from within the base to gain additional elevation on the tee. Based upon these observations, the NFL mandated that, going forward, all approved football tees were required to be made of one piece. Thus, evolved the GROUND ZERO®-1 tee which looks exactly like the tee depicted in U.S. Pat. No. D 383,816, but was molded in a single piece. The TOE-TAL® tee and its successor the GROUND ZERO®-1 tee have been used in every NFL game since the 1999 season, now 12 consecutive years. Although other tees are legal for use in NFL games, the GROUND ZERO®-1 tee has become the tee of choice for NFL kickers.

As football tee configurations evolved by Applicant, there became a need for a tee which could be used to standardize execution of onside kicks. As is known, onside kicks are typically used when a team is behind in the score late in the game and wants to try to recover its own kickoff after a score to attempt to catch up to the other team's score. In the game of American football, during a kickoff, after the ball has traveled 10 yards, it is considered a live ball that either team can recover. However, there is a proviso in the rules that says that the receiving team can call for a "fair catch" of any kickoff that has traveled at least 10 yards in the air and, if a fair catch is requested, the receiving team must be permitted to catch the ball without interference from the kicking team.

Based upon this combination of rules, if the kicking team wants to recover an onside kick, they must kick the ball in such a manner that it bounces off the ground at least once in the first 10 yards of travel. If this occurs, the receiving team may not execute the "fair catch" signal and, once the ball travels 10 yards, either team may recover it. Thus, kickers have tried to perfect the technique of driving the ball into the ground and having it bounce high in the air somewhere above the field, but more than 10 yards from the spot it was kicked to give the kicking team an opportunity to recover it. In order to best facilitate practicing and executing such an onside kick, Applicant developed the GROUND ZERO ONSIDE® tee which is covered by U.S. Pat. Nos. 6,309,316 issued Oct. 30, 2001, D 489,779 issued May 11, 2004, D 507,315 issued Jul. 12, 2005, D 507,814 issued Jul. 26, 2005, and D 513,775 issued Jan. 24, 2006. The GROUND ZERO ONSIDE® tee as currently manufactured most closely resembles the tees claimed in U.S. Pat. Nos. D 507,315 and D 513,775. The GROUND ZERO ONSIDE® tee is not legal for use in NFL games, but has evolved to become the most popular football tee used in college football in the United States, particularly in National Collegiate Athletic Association (NCAA) sanctioned games. Applicant estimates that at least 80% of college kickers use the GROUND ZERO ONSIDE® tee. A description and explanation of the evolution of the GROUND ZERO ONSIDE® tee is set forth in detail in the text of U.S. Pat. No. 6,309,316, particularly in the BACKGROUND OF THE INVENTION section of that patent, and is incorporated herein by reference.

Additionally, in high schools, kickers make frequent use of the TOE-TAL® tee, not only in the configuration shown in U.S. Pat. No. D 383,816, but also in the configuration shown in U.S. Pat. No. D 383,817 as a kicking block on which the ball may be held for field goals and also as shown in particular in FIGS. 1-3 of U.S. Pat. No. D 392,705 without the base as a one quarter inch kickoff tee or a one inch block. Additionally, a two inch version of the GROUND ZERO®-1 tee, known as the GROUND ZERO®-2 tee, allows kickoffs with the ball elevated two inches which is legal in high schools, but not in college or the professional ranks. Many high school kickers use the GROUND ZERO®-2 tee for kickoffs. In combination, the TOE-TAL® tee and the GROUND ZERO®-2 tee are the most popular high school tees currently used.

As kickers have used the TOE-TAL® tee and GROUND ZERO® tees, Applicant has observed that those kickers prefer to place the ball within the ball receiving recess as lightly as possible. The ball receiving recess has been designed with a forward facing opening that is framed by two flexible ribs that dig into the football when its tip is pushed into the recess to support the ball adequately even under strong wind conditions. However, despite this fact, kickers prefer to support the ball in the recess as lightly as possible. As such, a need has developed to support the ball in the manner for which the TOE-TAL® and GROUND ZERO® tees are known, in which a surface shaped at least partially in conformance with the shape of the tip of the football is employed, however, with a reduced surface area to reduce the resistance of the tee to kicking the ball out of the recess. It is with this need in mind that the present invention was also developed.

In the continuing evolution of football tees to be used in the game of American football, kickers strive to learn all of the techniques necessary to give them the versatility necessary to become a valuable player on a football team. These techniques include not only executing field goals, but different kinds of kickoffs, such as long kickoffs, onside kicks, squib kicks, and directional kicking. Kickers like to be able to have one tee that can facilitate accomplishment of all of the techniques they wish to exercise.

As such, a need has developed for a football tee that combines into a single product the ability to kick long kickoffs, directional kickoffs, onside kicks, and squib kicks with the football being supported in each case in a way that can be repeatedly practiced and then used in the same way under game conditions. It is with this thought in mind that the present invention was developed.

SUMMARY OF THE INVENTION

The present invention relates to multi-purpose football tees. The present invention includes the following interrelated objects, aspects, and features:

(1) In a first aspect, the present invention contemplates combining three ball receiving recesses in a single football tee. Applicant's assignee, Premium Products, Inc., founded by Applicant in 1985, intends to market this new and innovative tee under the Trademark Triple Play™. The ball receiving recesses include a first ball receiving recess for conventional kicks, a second ball receiving recess for squib kicks, and a third ball receiving recess for onside kicks.

(2) In each of the embodiments of the present invention as described and claimed herein, the first ball receiving recess which is intended for conventional kickoffs has a reduced surface area and, notably, the absolute tip of the football is suspended above any tee structure so that it is not engaging any tee structure.

(3) In a first embodiment of the present invention, the first ball receiving recess consists of a plurality of elongated arcuate lines separated by scalloped regions, with each line conforming to the shape of the surface of the football near the tip. These lines have lower terminations above the absolute tip of the football so that the absolute tip of the football and a short portion of the surface of the football above the tip thereof are not engaged with any tee structure in the rearward and lateral directions. This reduction in surface area of engagement enhances the ease by which the ball may leave the tee when kicked.

(4) In a second embodiment of the present invention, the lines described in paragraph (3) above are replaced by a similar number of arcuate thick lines or narrow bands separated by scalloped regions, with each band conforming to the shape of the football above the tip thereof. The open area described with reference to the first-mentioned embodiment is also present in the second embodiment so that the absolute tip of the football and the portion of the football just above the tip thereof are suspended within the tee in the rearward and lateral directions, thereby reducing surface area of contact.

(5) In a third embodiment of the present invention, the arcuate lines or thick lines or bands are replaced with a series of semi-spherical projections or bumps, each of which engages the football in a point contact. Each of the points conforms to the shape of the football and the open area described with respect to the first and second embodiments is also present so that the football is supported by a multiplicity of point contacts, each of which is so located that it conforms to the outer shape of the football. The open area described with reference to the first and second embodiments is also present in the third embodiment.

(6) The arcuate lines, arcuate bands, or semi-spherical projections of the ball receiving recess may each be described as encompassing a discrete surface region of relatively small surface area, particularly as compared to the surface area of a tip of a football supported in said recess or the ball receiving recess of Applicant's prior art tees or even the surface area of one-half or even one-fourth the area of that prior art recess.

(7) As is the case in Applicant's earlier patented football tees, two ribs frame the forward opening of the first ball receiving recess to hold the ball in place until it is kicked from the recess. Thus, in each embodiment, the sole support of the football in the first ball receiving recess comprises one of (a) a multiplicity of arcuate lines; (b) a multiplicity of arcuate bands; or (c) a multiplicity of points and, additionally, the pair of ribs.

(8) In Applicant's prior art tees, forward of the ball receiving recess was a generally rectangular cubic recess sized and configured to allow the tip of the football to leave the tee unobstructed when the ball is kicked. In the present invention, such a recess is provided and performs that same function, but in accordance with the teachings of the present invention, that recess now has an additional function. In particular, the second recess in each embodiment is also shaped like the tip of the football, but in the reverse direction so that the opening of the second recess faces rearward toward the opening of the first recess. The second recess is preferably devoid of any ribs and so a football may be placed in the second recess in any rotative orientation to allow a kicker to use that recess to execute squib kicks. Thus, a football may be placed in the second recess with the laces facing forward, rearward, sideways, or any other direction as the kicker desires, to enable execution of any type of squib kick.

(9) The third recess of Applicant's TRIPLE PLAY™ tee in each embodiment is at the forward end of the tee and is used in executing onside kicks. That recess is the same or similar to the onside kick recess illustrated in U.S. Pat. Nos. D 507,315 and D 513,775.

As such, it is a first object of the present invention to provide multi-purpose football tees.

It is a further object of the present invention to provide embodiments of such tees including three ball supporting locations on a single tee.

It is a further object of the present invention to provide such a tee in which a second recess used to allow the tip of the football to escape a first recess is configured to also facilitate support of a football.

It is a still further object of the present invention to provide such a tee in embodiments in which the surface area of support of a football in its first recess is dramatically reduced.

It is a yet further object of the present invention to provide such a tee in which that dramatic reduction in surface area is accomplished through a series of line contacts with a football.

It is a still further object of the present invention to provide such reduced surface through the use of a plurality of narrow bands of contact.

It is a still further object of the present invention to provide such reduced surface area of contact through the use of a plurality of semi-spherical structures allowing support of the football at a multiplicity of points.

It is a still further object of the present invention to provide such a football tee in which the surface area of contact is reduced by reducing the extent of contact of contacting surfaces by providing a lower open area that suspends the tip of the football and adjacent portions thereof so that they are devoid of any physical contact with any tee structure.

It is a yet further object of the present invention to provide such a football tee with a third recess designed to best facilitate onside kicks.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 6:
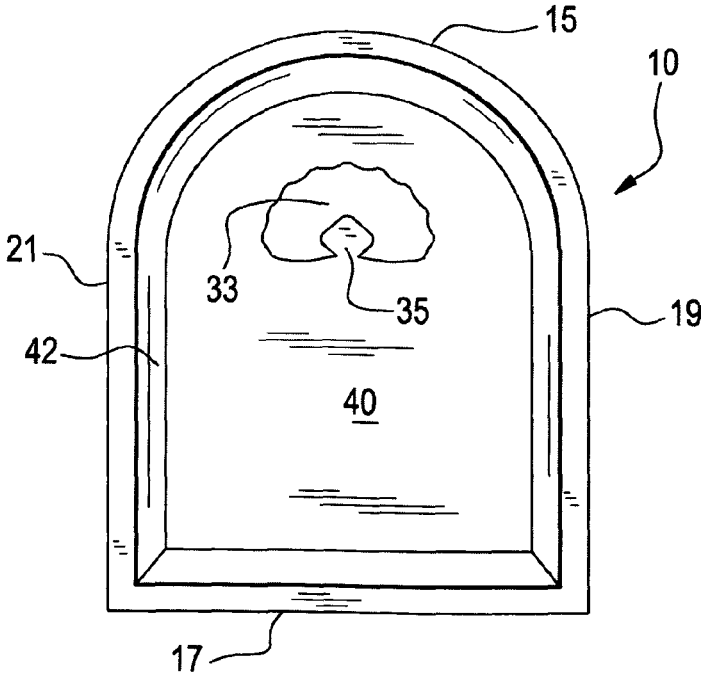
FIG. 6 shows a bottom view of all three embodiments of the present invention.

Reference is first made to FIGS. 1-6 which illustrate a first embodiment of the present invention generally designated by the reference numeral 10. The kicking tee identified with reference numeral 10 has a body 11 as well as a top 13 and a bottom 40 (FIG. 6). The kicking tee 10 includes a rear surface 15, side surfaces 19 and 21, and a forward surface 17.

Figure 1:
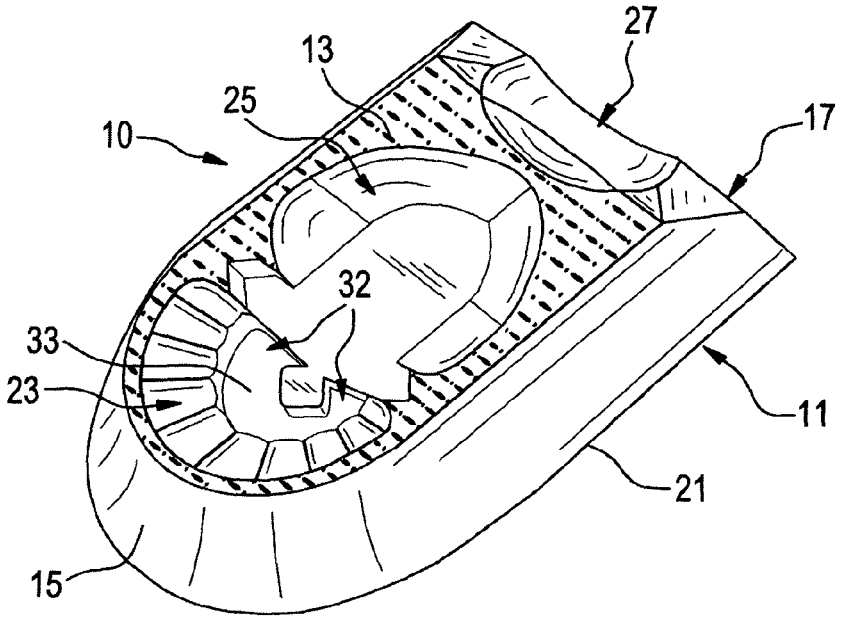
FIG. 1 shows a perspective view of a first embodiment of the present invention in which the first ball receiving recess contacts the football with a plurality of line contacts.
Figure 2:
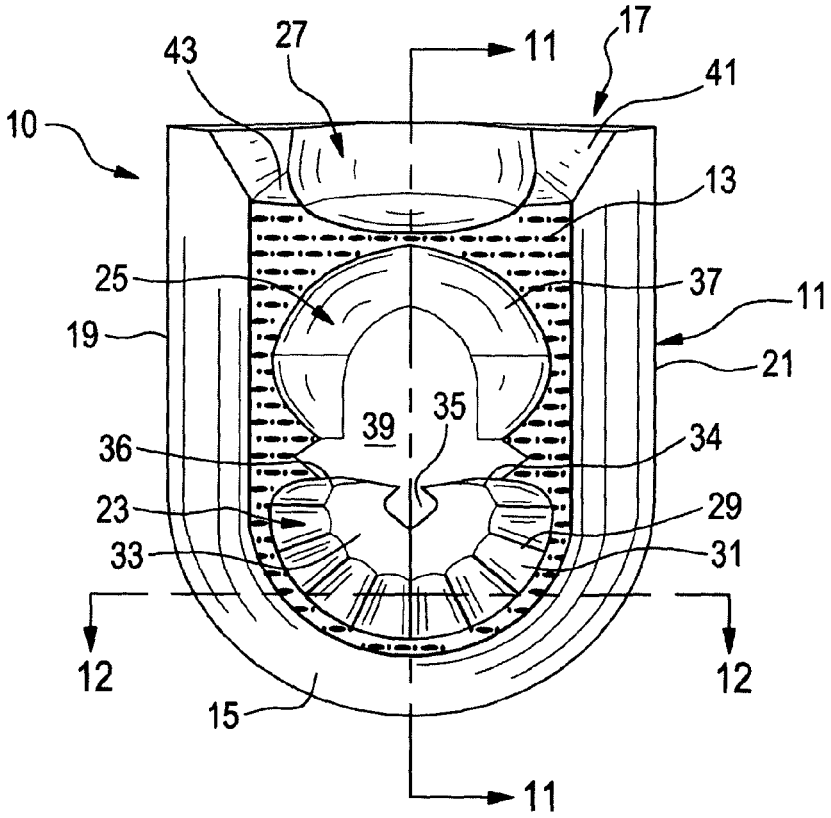
FIG. 2 shows a top view of the embodiment of FIG. 1.
Figure 3:
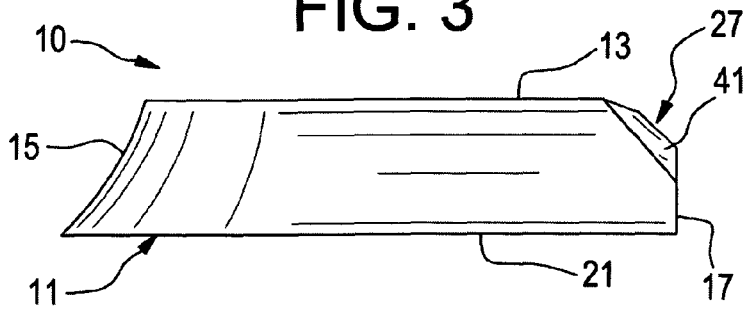
FIG. 3 shows a side view of the present invention which is the same for all three embodiments thereof. The other side is identical.
Figure 4:
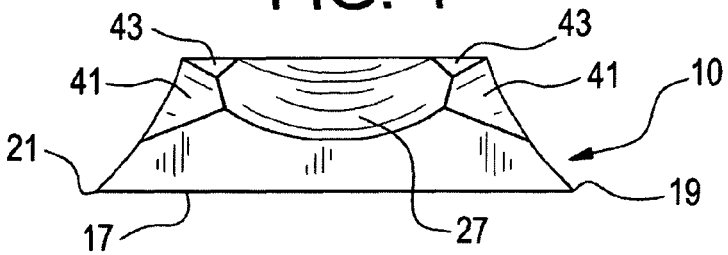
FIG. 4 shows a front view of all three embodiments of the present invention.
Figure 5:
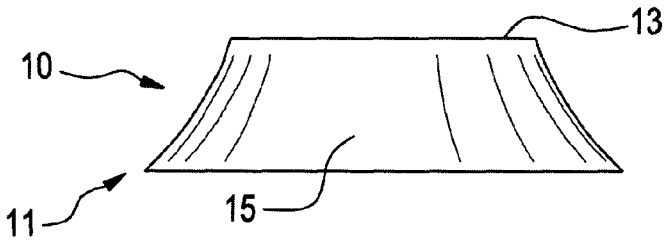
FIG. 5 shows a rear view of all three embodiments of the present invention.

The top surface 13 includes a roughened or otherwise patterned surface as particularly shown in FIGS. 1 and 2 which is provided merely for decoration.

Depending downwardly from the top surface 13 are three recesses 23, 25 and 27. The recess 23 includes scalloped portions 31 with adjacent scalloped portions 31 intersecting at arcuate lines 29. Each of the arcuate lines 29 has a shape that conforms to the shape of a portion of the end of an oblate spheroidal football. The scalloped portions 31 do not engage the surface of a football placed within the recess 23—the lines 29 do engage the football.

Figure 11:
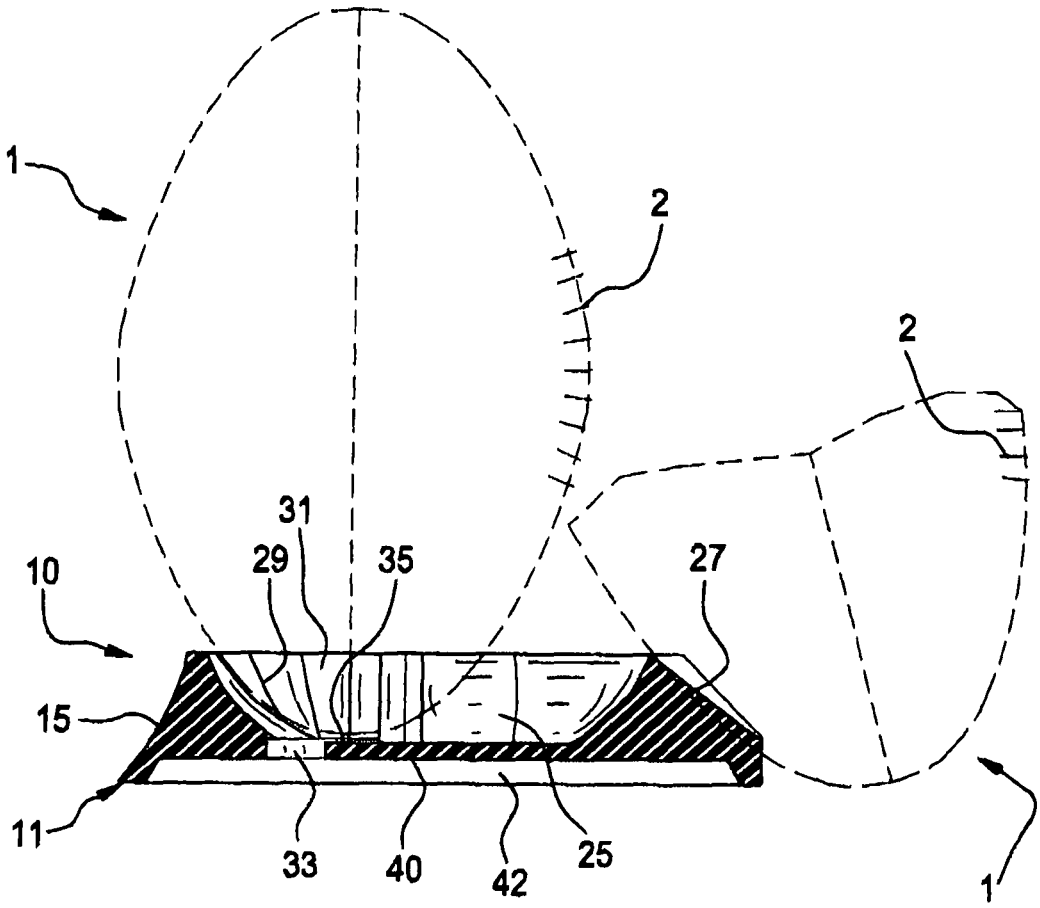
FIG. 11 shows a cross-sectional view along the line 11-11 of FIG. 1.
Figure 12:
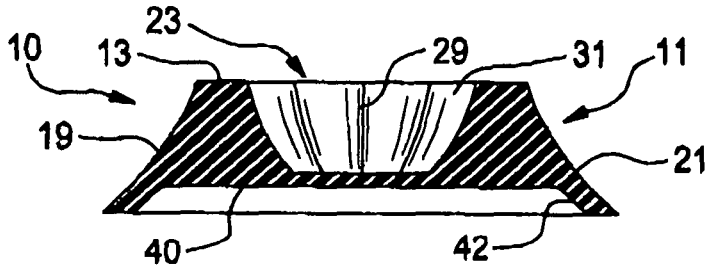
FIG. 12 shows a cross-sectional view along the line 12-12 of FIG. 1.
Figure 13:
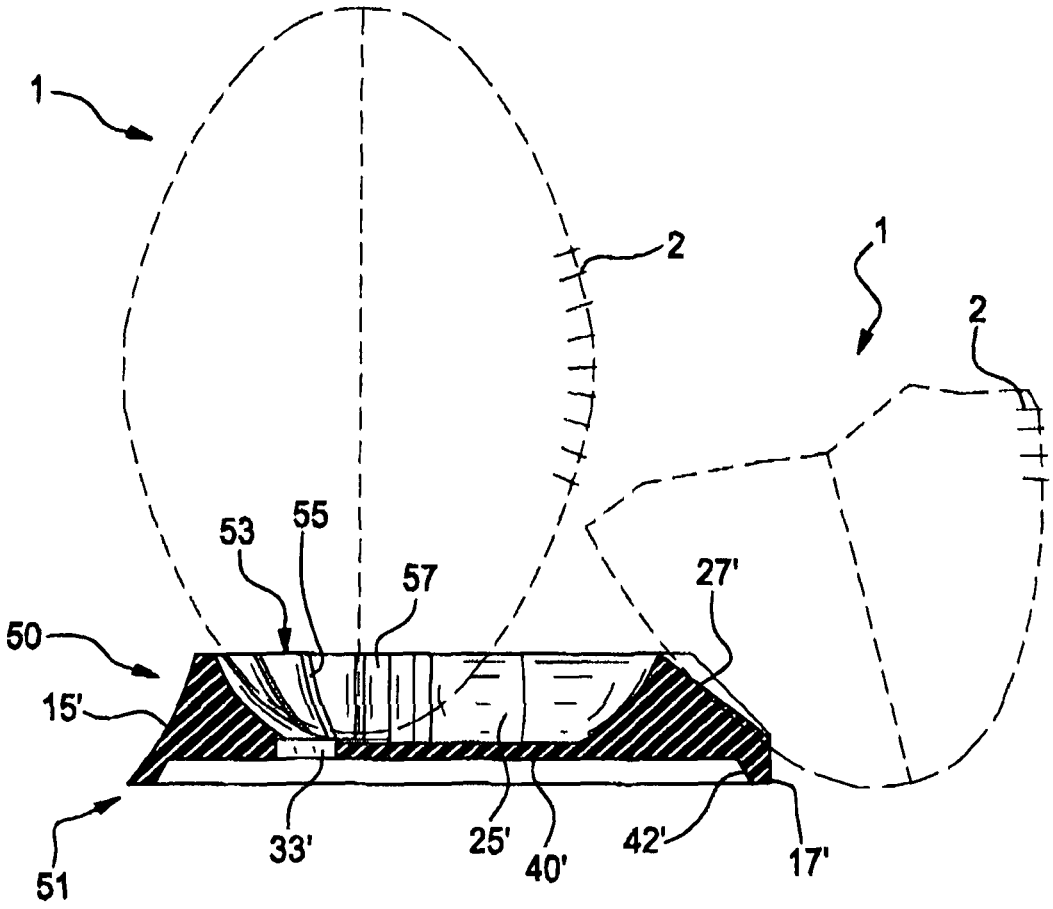
FIG. 13 shows a cross-sectional view along the line 13-13 of FIG. 8.
Figure 14:
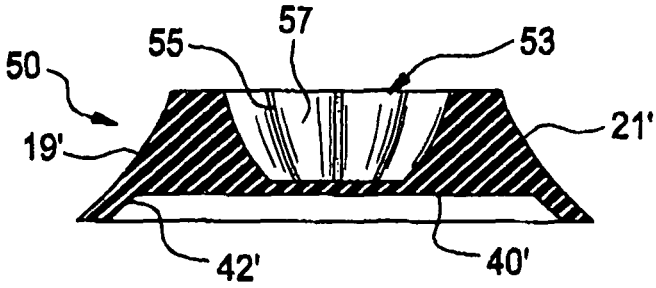
FIG. 14 shows a cross-sectional view along the line 14-14 of FIG. 8.
Figure 15:
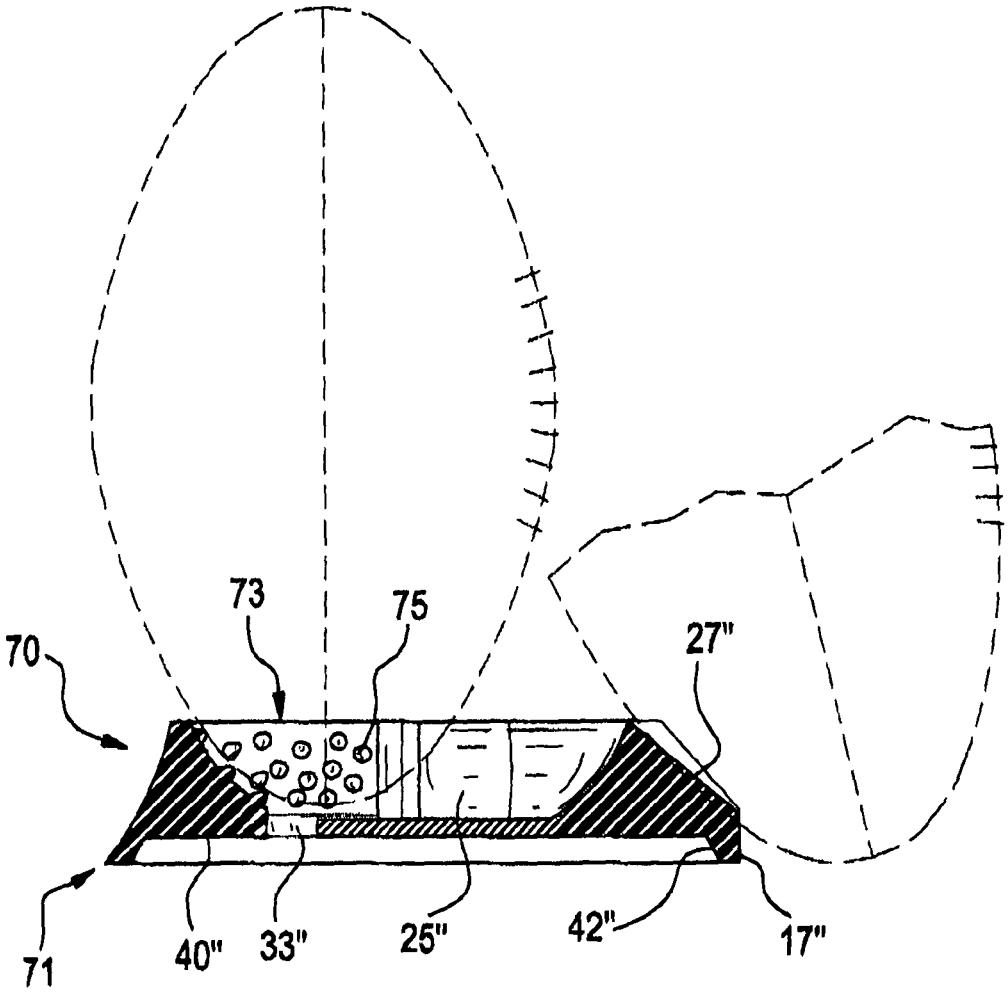
FIG. 15 shows a cross-sectional view along the line 15-15 of FIG. 10.
Figure 16:
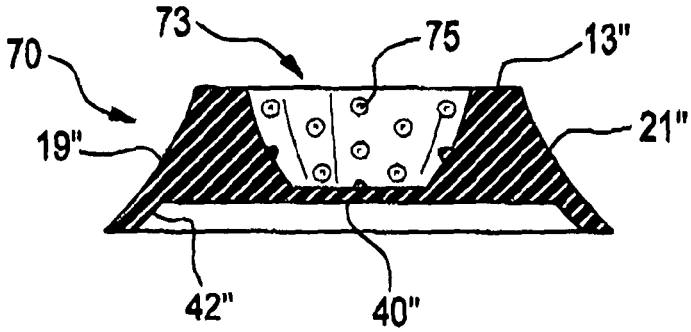
FIG. 16 shows a cross-sectional view along the line 16-16 of FIG. 10.

As understood with reference to FIGS. 1, 2 and 11, the arcuate lines 29 and the scalloped portions 31 terminate approximately halfway down the recess at a large opening 33 that extends completely through the body 11 as also understood with reference to FIG. 6. Additionally, a generally diamond-shaped surface 35 is aligned with the very tip of a football 1 placed within the recess 23 (FIG. 11). However, the surface 35 does not touch the very tip of the football 1 when it is placed in the recess 23. As clearly seen in FIG. 11, the very tip of the football 1 is slightly suspended above the surface 35 of the recess 23.

Thus, additionally, a pair of opposed flexible ribs 34 and 36 protrude into a forward opening 32 of the recess 23. The opening 32 is provided to allow a football placed in the recess 23 to easily leave the recess 23 when it is kicked in the direction of the wall 17.

Thus, it should be understood that when a football is placed into the recess 23, the only structures of the recess 23 that engage the football are the ribs 32 and 34 and the surfaces of the lines 29. Thus, as compared to prior art versions of Applicant's tees, the surface area of contact between the recess 23 and a football 1 is drastically reduced.

In prior versions of Applicant's tees, a generally rectangular cubic recess is provided forward of the rear ball receiving recess to provide an open space for the tip of the football to escape the tee when it is kicked. In accordance with the teachings of the present invention, such a recess 25 is provided, however, its configuration differs from the configuration of prior art such recesses. In particular, the recess 25 is shaped in conformance with the shape of the tip of an oblate spheroidal football. However, the recess 25 is open in the rearward direction so that a football may easily be kicked from the recess 25 in the direction toward the recess 23. The recess 25 has a floor 39 at the same level as the surface 35, but is designed so that the tip of the football 1 sits on the floor 39. There is no engagement between the ribs 34 and 36 of a football placed in the recess 25. A user may place a football within the recess 25 and its tip will engage the surfaces 37 of the recess 25 in any rotative orientation of the football 1. The recess 25 may be employed for squib kicks or even long kickoffs if so desired by a kicker.

With further particular reference to FIGS. 1 and 2, the kicking tee 10 also includes a recess 27 and surfaces 41 and 43 which conform with corresponding structures in Applicant's U.S. Pat. Nos. D 507,315 and D 513,775. The recess 27 has a surface conforming to a portion of the side surface of a football so that a football can be leaned against the surface 27 with the tip of the football resting on a ground surface so that onside kicks can be performed. The surfaces 41 and 43 are provided to allow additional surfaces of the football to engage the tee 10 in various degrees of lean.

Figure 7:
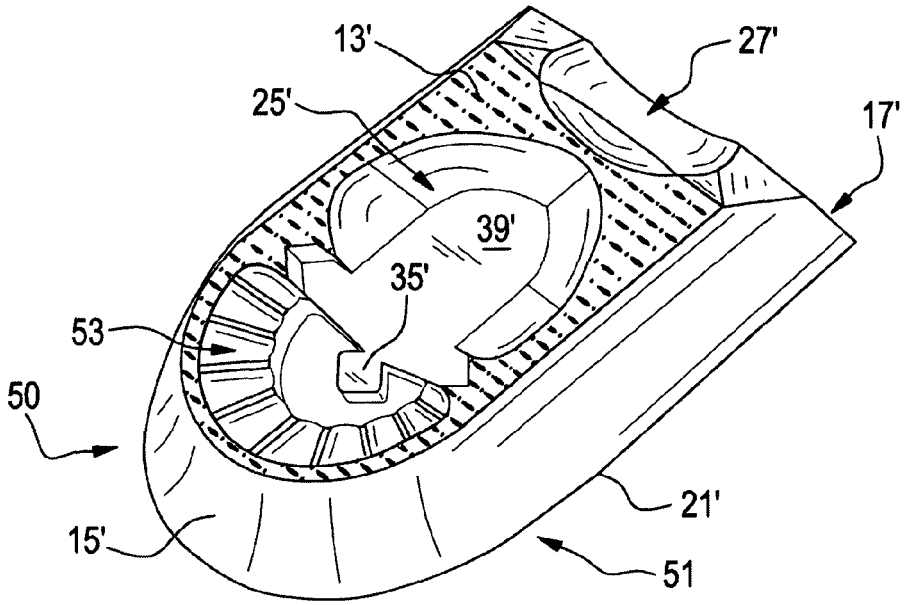
FIG. 7 shows a perspective view of a second embodiment of the present invention in which the football is supported in its first recess by a plurality of bands.
Figure 8:
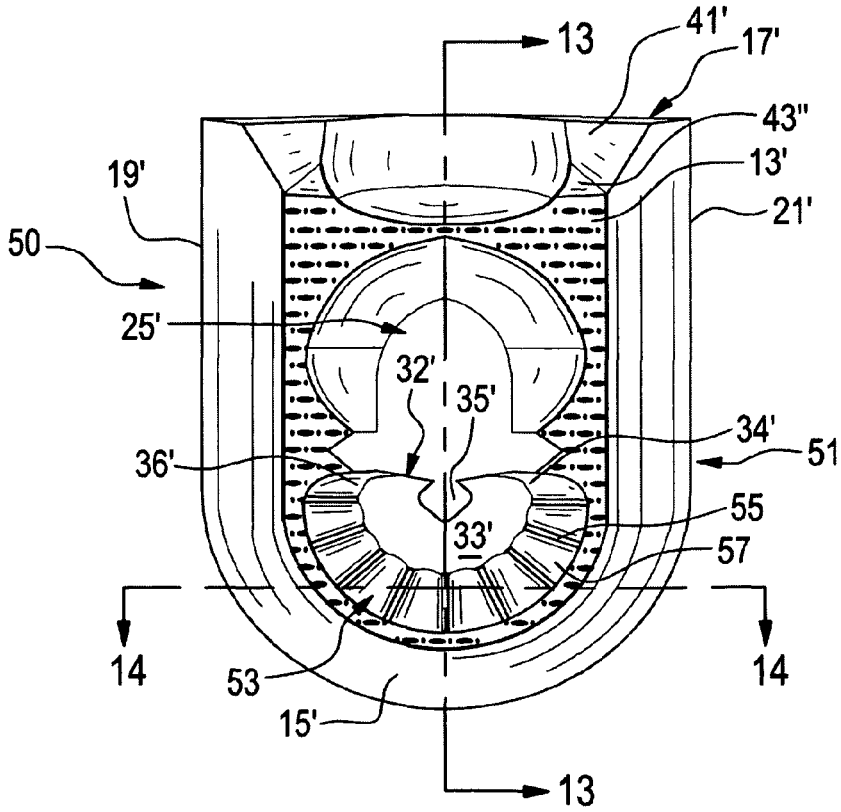
FIG. 8 shows a top view of the embodiment of FIG. 7.

Reference is now made to FIGS. 7 and 8 which depict a second embodiment of the present invention generally designated by the reference numeral 50. First, it is noted that the views set forth in FIGS. 3-6, namely, side, front, rear and bottom views, are equally applicable to the tee 50 depicted in FIGS. 7, 8, 13 and 14. In FIGS. 7, 8, 13 and 14, like elements as compared to the embodiment of FIGS. 1-6 are shown using like primed reference numerals.

The tee 50 has a body 51 and surfaces 15', 17', 19' and 21'. The tee 50 also includes a recess 25' and a recess 27'. The tee 50 differs from the tee 10 in features of the recess 53 thereof. In particular, the recess 53 includes scalloped portions 57. Adjacent scalloped portions 57 intersect at arcuate thin surfaces or bands 55. As shown, comparing the surfaces or bands 55 with the lines 29 from the recess 23 of the embodiment of FIGS. 1-6, the surfaces or bands 55 are merely slightly wider than the lines 29. The surfaces or bands 55 conform to the outer surface of an oblate spheroidal American football. In the same manner as is the case with the arcuate lines 29, the surfaces or bands 55 do not extend all the way to the bottom of the recess 53, but rather terminate as shown in an enlarged opening 33'. In the same manner as is the case in the embodiment of FIGS. 1-6, the surface 35' is located directly under the extreme tip of a football 1 placed within the recess 53, but is slightly spaced under the tip of the football 1 placed in the recess 53. The recess 53 has a forward opening 32' that is framed by the ribs 34' and 36'. Thus, similarly to the embodiment of FIGS. 1-6, when a football 1 is placed within the recess 53, as better shown in FIG. 13, the only structures of the recess 53 engaging the surface of the football are the surfaces or bands 55 and the ribs 34' and 36'. In the preferred construction, the surfaces or bands have a width of from 1/16" to 3/16".

Figure 9B:
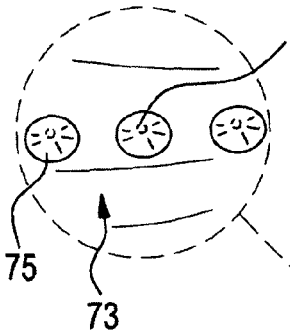
FIG. 9*b* shows an enlargement of a portion of the first ball receiving recess to show details.
Figure 9A:
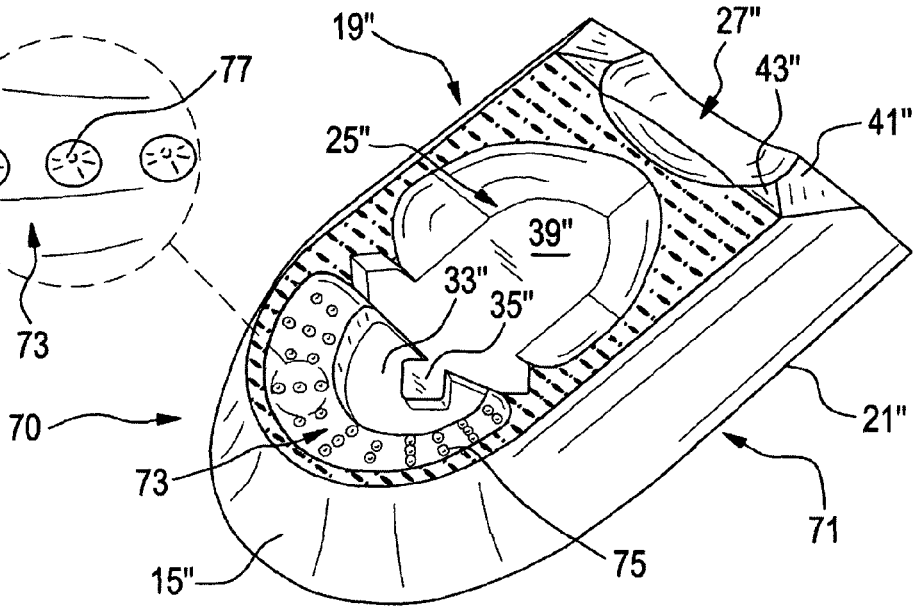
FIG. 9*a* shows a perspective view of a third embodiment of the present invention in which the football is supported in the first ball receiving recess by a plurality of semi-spherical portions that support the football at a multiplicity of point contacts.
Figure 10:
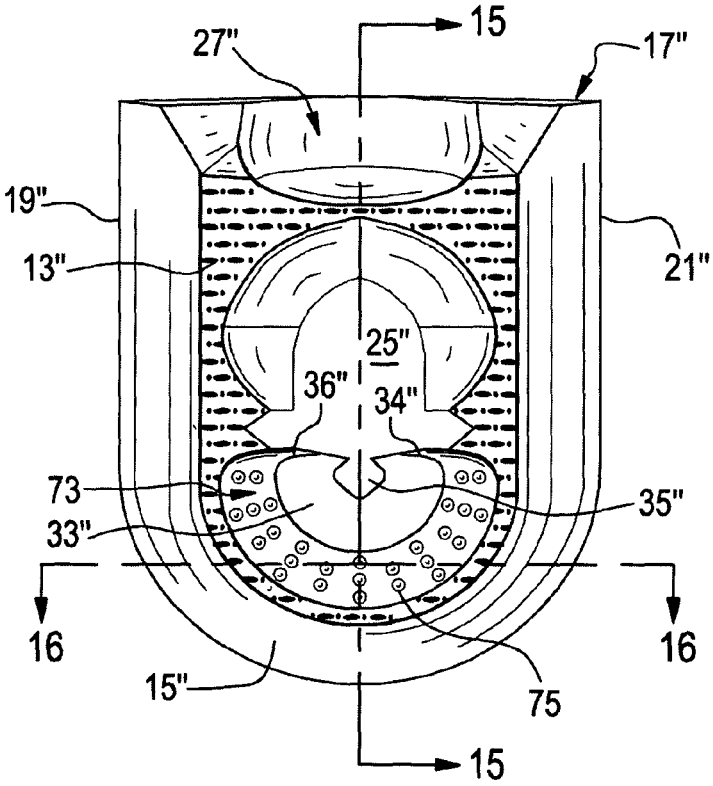
FIG. 10 shows a top view of the third embodiment of the present invention.

With reference to FIGS. 9*a*, 9*b*, 10 and 15-16, a third embodiment of the present invention is generally designated by the reference numeral 70. As is the case with the football tee 50 shown in FIGS. 7-8 and 13-14, the structures shown in FIGS. 3-6 are equally applicable to the tee 70. With reference to FIGS. 9*a*, 9*b*, 10 and 15-16, as compared to the embodiment of FIGS. 1-6, corresponding structures are designated by like double-primed reference numerals. With reference to FIGS. 9*a*, 9*b* and 10, in particular, the kicking tee 70 includes a middle recess 25" and a forward recess 27". The difference between the kicking tee 70 and the kicking tees 10 and 50 concerns the configuration of the recess 73. In particular, with reference to FIGS. 9*a*, 9*b* and 10, it is seen that the recess 73 includes a multiplicity of upraised generally semi-spherical bumps 75. These bumps include tips 77 (FIG. 9*b*) which are the sole structure of the bumps 75 that engage a football 1 placed within the recess 73.

As should be understood, each of the bumps 75 has a tip 77. All of the tips 77 are so located that they conform to points in the outer shape of an oblate spheroidal American football. Additionally, the recess 73 includes a surface 35" that is located directly below the extreme tip of the football 1, but spaced below slightly so that it does not engage the tip of a football placed within the recess 73. The recess 73 also includes ribs 34" and 36". Thus, when a football is placed within the recess 73, as best seen with reference to FIG. 15, the only structures engaging the football are the tips 77 of the bumps 75 and the ribs 34" and 36". As such, in the embodiment of FIGS. 9*a*, 9*b*, 10 and 15-16, the surface area of contact between the tee 70 and a football 1 when placed within the recess 73 is drastically reduced as compared to the surface area of contact in Applicant's prior tee configurations as described in the Background of the Invention. In the preferred construction, the bumps 75 have a base diameter of from 1/16" to 3/16". If desired, the tips 77 may be somewhat flattened so long as the tip surfaces together conform to the outer shape of an oblate spheroidal American football.

The recesses 25" and 27" are the same as the corresponding recesses in the kicking tees 10 and 50.

The arcuate lines, arcuate bands, or semi-spherical projections of the ball receiving recess may each be described as encompassing a discrete surface region of relatively small surface area, particularly as compared to the surface area of a tip of a football supported in said recess or the ball receiving recess of Applicant's prior art tees or even the surface area of one-half or even one-fourth the area of that prior art recess.

In accordance with the teachings of the three embodiments of the present invention, great versatility is incorporated into a single tee configuration. With one tee, a kicker may kick a football straight down the field as high and far as he or she can, and can carry out squib kicks and onside kicks in manners that may be well practiced for great proficiency.

In the preferred construction of the embodiments of the inventive tee, they are made of reclaimed rubber. Of course, other suitable materials may be used including synthetic or natural rubber, soft plastics, room temperature vulcanize and the like.

Accordingly, an invention has been disclosed in terms of preferred embodiments thereof which fulfill each and every one of the objects of the present invention and provide new and useful multi-purpose football tees of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A football tee, comprising:

a) a body supportable on a ground surface;

b) said body having a top surface spaced from said ground surface;

c) a recess depending downwardly from said top surface, said recess including a plurality of discrete spaced first surface regions, each of said discrete spaced first surface regions conforming to an outer surface of an oblate spheroidal football adjacent a tip of said football and encompassing a small surface area as compared to a surface area of a portion of said football adjacent said tip, said recess including a second surface region separating said first surface regions from one another, said portion of said football adjacent said tip configured to be supported in said recess;

d) whereby when a tip and an adjacent portion of an oblate spheroidal football are inserted into said recess, said portion is engaged by said discrete spaced first surface regions to support said football within said recess while said second surface region is spaced from and does not engage said tip and adjacent portion of said oblate spheroidal football.

2. The tee of claim 1, wherein said second surface region a comprises at least one scalloped region.

3. The tee of claim 1, wherein said tee includes a bottom opening in said recess, whereby when said tip and said portion of said oblate spheroidal football adjacent said tip are inserted into said recess, said tip is spaced from all surfaces of said recess.

4. The tee of claim 2, wherein said tee includes a bottom opening in said recess, whereby When said tip and said portion of said oblate spheroidal football adjacent said tip are inserted into said recess, said tip is spaced from all surfaces of said recess.

5. The tee of claim 1, wherein said discrete spaced first surface regions are chosen from the group consisting of arcuate lines, narrow arcuate bands, and bumps.

6. The tee of claim 5, wherein said discrete spaced first surface regions comprise arcuate lines.

7. The tee of claim 5, wherein said discrete spaced first surface regions comprise narrow arcuate bands.

8. The tee of claim 5, wherein said discrete spaced first surface regions comprise bumps.

9. The tee of claim 8, wherein said bumps comprise semi-spherical projections.

10. The tee of claim 1, wherein said recess has a top opening and a bottom opening.

11. The tee of claim 10, wherein said discrete spaced first surface regions extend from adjacent said top opening toward said bottom opening.

12. The tee of claim 11, wherein said bottom opening extends from a lower termination thereof toward said top opening, an upper termination of said bottom opening defining a lower termination of said discrete spaced first surface regions.

13. The tee of claim 1, wherein said recess includes a forward opening framed by a pair of ribs.

14. The tee of claim 13, wherein said recess comprises a first recess, said tee further comprising a second recess beyond said ribs and sized to permit a tip of a football to leave said tee unimpeded when said football is kicked from said first recess.

15. The tee of claim 14, wherein said second recess is shaped in partial conformance with a surface adjacent a tip of an oblate spheroidal football.

16. The tee of claim 15, wherein said second recess has a lateral opening facing said first recess.

17. The tee of claim 14, further including a forward wall in which a third recess is located.

18. The tee of claim 17, wherein said third recess is shaped in substantial conformance with a portion of a side wall of an oblate spheroidal football, whereby a football may be supported with its tip on said ground surface and a side wall thereof leaning on said third recess.

19. A football tee, comprising:

a) a body supportable on a ground surface;

b) said body having a top surface spaced from said ground surface;

c) a first recess depending downwardly from said top surface, said first recess including a plurality of discrete spaced first surface regions, each of said discrete spaced first surface regions conforming to an outer surface of an oblate spheroidal football adjacent a tip of said football and encompassing a small surface area as compared to a surface area of a portion of said football adjacent said tip thereof, said portion of said football adjacent said tip configured to be supported in said recess;

d) whereby when a tip and adjacent portion of an oblate spheroidal football are inserted into said recess, said portion is engaged by said discrete spaced first surface regions to support said football within said recess, said recess further including second surface regions, said second surface regions separating said first surface regions, said second surface regions spaced from said tip and adjacent portion of said oblate spheroidal football; and e) a second recess forward of said first recess and sized to permit a tip of a football to leave said tee unimpeded when said football is kicked from said first recess, said second recess being shaped in partial conformance with a surface adjacent a tip of an oblate Spheroidal football.

20. The tee of claim 19, further including a forward wall in which a third recess is located, said third recess being shaped in substantial conformance with a portion of a side wall of an oblate spheroidal football, whereby a football may be supported with its tip on said ground surface and a side wall thereof leaning on said third recess.

21. The tee of claim 19, wherein said first recess includes a forward opening framed by a pair of ribs.

22. The tee of claim 19, wherein said second recess has a lateral opening facing said first recess.

23. The tee of claim 19, wherein said discrete spaced first surface regions are chosen from the group consisting of arcuate lines, narrow arcuate bands, and bumps.

24. The tee of claim 19, wherein said first recess has a top opening and a bottom opening.

25. A football tee, comprising:

a) a body supportable on a ground surface;

b) said body having a top surface spaced from said ground surface and a forward surface, said top surface having a peripheral edge;

c) a first recess depending downwardly from said top surface, said first recess shaped in partial conformance with a surface of an oblate spheroidal football adjacent a tip of said football, and having a plurality of discrete surface regions designed to engage said surface of said football when placed in said first recess, said first recess having a forward facing opening framed by a pair of ribs;

d) a second recess forward of said first recess and depending downwardly from said top surface, said second recess being spaced inwardly from said peripheral edge of said top surface and being shaped in partial conformance with said surface of said oblate spheroidal football and having a rearward facing opening; and e) a third recess formed in said forward surface, said third recess being shaped in partial conformance with a side wall of an oblate spheroidal football to support a football with its tip on said ground surface and a side wall thereof engaging said third recess.

26. A football tee, comprising:

a) a body supported on a ground surface;

b) said body having a top surface spaced from said ground surface;

c) a recess depending downwardly from said top surface, said recess including a plurality of discrete spaced surface regions comprising narrow arcuate bands, each of said discrete spaced surface regions conforming to an outer surface of an oblate spheroidal football adjacent a tip of said football and encompassing a small surface area as compared to a surface area of a portion of said football adjacent said tip, said portion of said football adjacent said tip configured to be supported in said recess;

d) whereby when a tip and an adjacent portion of an oblate spheroidal football are inserted into said recess, said portion is engaged by said discrete spaced surface regions to support said football within said recess;

e) each discrete surface region being adjacent at least one additional region of said recess spaced from said portion of said football.

27. A football tee, comprising:

a) a body supported on a ground surface;

b) said body having a top surface spaced from said ground surface;

c) a recess depending downwardly from said top surface, said recess including a plurality of discrete spaced surface regions comprising bumps, each of said discrete spaced surface regions conforming to an outer surface of an oblate spheroidal football adjacent a tip of said football and encompassing a small surface area as compared to a surface area of a portion of said football adjacent said tip, said portion of said football adjacent said tip configured to be supported in said recess;

d) whereby when a tip and an adjacent portion of an oblate spheroidal football are inserted into said recess, said portion is engaged by said discrete spaced surface regions to support said football within said recess;

e) each discrete surface region being adjacent at least one additional region of said recess spaced from said portion of said football.

* * * * *